US009759505B2

(12) United States Patent
Al Abdouli et al.

(10) Patent No.: US 9,759,505 B2
(45) Date of Patent: Sep. 12, 2017

(54) AUTOMATIC FIRING APPARATUS AND METHOD

(71) Applicant: United Arab Emirates University, Al Ain (AE)

(72) Inventors: Ibrahim Al Abdouli, Al Ain (AE); Mohammad Arbabi, Al Ain (AE); Saleh Al Marri, Al Ain (AE); Basel Al Sayyed, Al Ain (AE)

(73) Assignee: United Arab Emirated University (AE)

( * ) Notice: Subject to any disclaimer, the term of this patent is extended or adjusted under 35 U.S.C. 154(b) by 0 days.

(21) Appl. No.: 15/223,676

(22) Filed: Jul. 29, 2016

(65) Prior Publication Data

US 2016/0334179 A1 Nov. 17, 2016

Related U.S. Application Data

(62) Division of application No. 14/691,983, filed on Apr. 21, 2015.

(60) Provisional application No. 62/119,653, filed on Feb. 23, 2015.

(51) Int. Cl.

| | |
|---|---|
| ***F41A 9/00*** | (2006.01) |
| ***F41A 19/64*** | (2006.01) |
| ***F41A 9/84*** | (2006.01) |
| ***F41A 31/00*** | (2006.01) |
| ***F41A 9/64*** | (2006.01) |
| ***F41A 9/59*** | (2006.01) |

(52) U.S. Cl.

CPC ..... *F41A 19/64* (2013.01); *F41A 9/59* (2013.01); *F41A 9/64* (2013.01); *F41A 9/84* (2013.01); *F41A 31/00* (2013.01)

(58) Field of Classification Search

CPC ..... F41A 9/00; F41A 9/01; F41A 9/24; F41A 9/61; F41A 31/00; F41C 27/00

USPC ..... 89/45, 1.1, 33.1; 42/6, 49.01, 106, 90; 434/11, 24

See application file for complete search history.

(56) References Cited

U.S. PATENT DOCUMENTS

| | | | | |
|---|---|---|---|---|
| 2,147,208 A * | 2/1939 | Nolan | F41A 9/68 | 42/49.01 |
| 2,745,317 A * | 5/1956 | Stanton | F41A 9/21 | 414/564 |
| 2,792,757 A * | 5/1957 | Carlberg | F41A 9/21 | 89/1.802 |
| 2,910,917 A * | 11/1959 | Herlach | F41A 9/04 | 89/33.02 |

(Continued)

*Primary Examiner* — Jonathan C Weber
(74) *Attorney, Agent, or Firm* — Hayes Soloway PC

(57) ABSTRACT

There is provided an automatic firing apparatus, and a method for operating the automatic firing apparatus, the apparatus comprising a trigger actuator for automatically firing bullets contained in a magazine of a firearm; a magazine release actuator for releasing an empty magazine from the firearm; a magazine bank for storing a bullet magazine inside the firearm; and a magazine loading actuator for loading a new magazine inside the firearm from the magazine bank. There is further provided a magazine bank apparatus for use with a firearm comprising a magazine bank base having a plurality of slots adapted to receive and store bullet magazines; and a magazine load actuator adapted to be automatically triggered for loading a bullet magazine among the stored bullet magazines inside the firearm.

10 Claims, 6 Drawing Sheets

(56) References Cited

U.S. PATENT DOCUMENTS

| | | | | | |
|---|---|---|---|---|---|
| 3,122,967 | A * | 3/1964 | Johnson | F41A 9/01 | 89/46 |
| 3,828,458 | A * | 8/1974 | Skone-Palmer | F41A 19/56 | 42/106 |
| 4,495,853 | A * | 1/1985 | Gottwaldt | F41A 9/16 | 89/34 |
| 6,752,063 | B2 * | 6/2004 | Panek | F41A 9/16 | 89/45 |
| 7,878,101 | B2 * | 2/2011 | Heldmann | B63G 3/04 | 89/1.801 |
| 8,297,167 | B2 * | 10/2012 | Hoffman | F41A 7/08 | 89/1.4 |
| 8,336,442 | B2 * | 12/2012 | Testa | F41A 7/08 | 89/45 |
| 8,640,374 | B1 * | 2/2014 | Reichelt | F41C 27/00 | 42/106 |
| 9,175,923 | B2 * | 11/2015 | Ruby | F41C 27/00 | |
| 2010/0175547 | A1 * | 7/2010 | Hoffman | F41A 7/08 | 89/9 |
| 2012/0152103 | A1 * | 6/2012 | Testa | F41A 7/08 | 89/129.01 |
| 2012/0186423 | A1 * | 7/2012 | Chachamian | F41A 9/34 | 89/33.01 |
| 2014/0109451 | A1 * | 4/2014 | Beckman | F41A 9/27 | 42/1.02 |
| 2014/0223791 | A1 * | 8/2014 | Ruby | F41C 27/00 | 42/49.01 |
| 2015/0219425 | A1 * | 8/2015 | Beckman | F41H 11/00 | 89/1.11 |

* cited by examiner

AUTOMATIC FIRING APPARATUS AND METHOD

CROSS REFERENCE TO RELATED APPLICATIONS

This application is a divisional of co-pending U.S. application Ser. No. 14/691,983 filed on Apr. 21, 2015, which itself claims benefit of U.S. Provisional Application Ser. No. 62/119,653 filed on Feb. 23, 2015, each of which this application claims benefit from and the contents of which are hereby incorporated by reference.

FIELD OF THE INVENTION

The present invention relates generally to firearms, and more particularly to an automatic firearm apparatus and method of operation thereof.

BACKGROUND OF THE INVENTION

A firearm is a portable gun that fires a bullet which travels in a projectile motion. The firearm may be is used for security or defence purposes. There are many companies which manufacture firearms. One of the criterions for judging the quality of the firearm is endurance capacity of the firearm. The endurance capacity of the firearm relates to number of bullets the firearm is capable of continuously without encountering any problem. For determining the endurance capacity of a firearm an endurance test is usually performed in which a human operator shoots bullets from the firearm.

The manual endurance test for a firearm as is prevalent in the state of the art systems is has several limitations. One limitation is number of firearms may be tested using manual testing due to inherent capability of a human operator to work only for a limited number of times. A second limitation is cost of testing the firearms as the human operator needs to be paid for his or her services. A third limitation is that a human operator is limited in his or her capability to shoot only with a limited frequency which is below a satisfactory frequency level. A fourth limitation of manual testing of firearms is negative effect of the exhaust of the bullets on health of the human operator.

SUMMARY OF THE INVENTION

Therefore, there exists a need for an automatic firing apparatus that is safe, reliable, easy to use and maintain, stable, and portable. Further, the automatic firing apparatus should be configurable to fire and test different types of firearms which may have differing shapes and sizes.

As a first aspect of the invention, there is provided an automatic firing method comprising initiating a trigger actuator for automatically firing bullets contained in a magazine of a firearm; releasing the empty magazine using a magazine release actuator; and loading a new magazine inside to the firearm from a magazine bank adapted to store bullet magazines using a magazine loading actuator.

Preferably, the trigger actuator is any one of a hydraulic, electrical, pneumatic, or magnetic actuator.

Preferably, the magazine release actuator is any one of a hydraulic, electrical, pneumatic, or magnetic actuator.

Preferably, the magazine loading actuator is any one of a hydraulic, electrical, pneumatic, or magnetic actuator.

Preferably, the method further comprises automatically determining the number of bullets being fired, automatically initiating the magazine release actuator for releasing the empty magazine once all the bullets of the magazine are fired and automatically initiating the magazine loading actuator for loading the new magazine inside the firearm once the empty magazine is released and for reinitiating these actuator actions until exhaustion of all the magazines stored inside the magazine bank.

Preferably, the method further comprises automatically initiating a slider release actuator for releasing the fired bullets from the firearm and repeating the above steps until all the magazines inside the magazine bank are consumed.

Preferably, the slider release actuator is any one of a hydraulic, electrical, pneumatic, or magnetic actuator.

Preferably, the method further comprises automatically initiating a door actuator for opening a door to a discard box once the empty magazine is released, wherein the empty magazine is forced inside the discard box through the opened door using a magazine discard actuator after the door is opened.

Preferably, each one of the door actuator and the magazine discard actuator is any one of a hydraulic, electrical, pneumatic, or magnetic actuator.

Preferably, the method further comprises using a gripping actuator for automatically adjusting a gripping apparatus for securely gripping the firearm in place before initiating the triggering actuator.

Preferably, the method further comprises automatically releasing the gripping actuator after all the filled magazines stored in the magazine disk have been consumed.

Preferably, the slider release actuator is any one of a hydraulic, electrical, pneumatic, or magnetic actuator.

Preferably, the magazine disk is a rotatable magazine disk and wherein the loading action of a new magazine comprises rotating the magazine disk by a magazine disk actuator at a predefined angle, direction and time to make available the next filled magazine in position to be loaded inside the firearm.

Preferably, the torque required for rotating the magazine disk is preconfigured as a function of moment of inertia and angular acceleration of the magazine disk.

Preferably, the moment of inertia is a function of total weight of the magazine disk and radius of the magazine disk.

Preferably, the total weight of the magazine disk comprises a weight of the magazine disk and the weight of the plurality of filled magazines.

Preferably, the actions of the actuators are initiated and coordinated using an electronic circuit, a microcontroller or microprocessor.

Preferably, the method utilizes a power source comprising at least one of an AC plug-in power, fuel generated power, and a battery or any suitable other power source.

Preferably, the firing is conducted according to a firing frequency preconfigured using an electronic circuit, a microcontroller or a microprocessor.

Preferably, the method is for purpose of testing at least one of the firearm and the firearm bullets.

As a further aspect of the invention, there is provided an automatic firing apparatus comprising:

- a trigger actuator for automatically firing bullets contained in a magazine of a firearm;
- a magazine release actuator for releasing an empty magazine from the firearm;
- a magazine bank for storing a bullet magazine inside the firearm; and
- a magazine loading actuator for loading a new magazine inside the firearm from the magazine bank.

Preferably, the apparatus further comprises a slider release actuator for releasing the fired bullets from the firearm.

Preferably, the apparatus further comprises a door actuator and a magazine discard actuator, the door actuator being adapted for opening a door to a discard box once the empty magazine is released, wherein the empty magazine is forced inside the discard box through the opened door using the magazine discard actuator after the door is opened.

Preferably, the apparatus further comprises a gripping apparatus for securely receiving the firearm and a gripping actuator for automatically adjusting the gripping apparatus for securely gripping the firearm in place before initiating the triggering actuator.

Preferably, the magazine bank is a rotatable magazine disk, the apparatus further comprising a magazine disk actuator for rotating the magazine disk in predetermined angle, direction and time to make available the next bullet magazine in position to be loaded inside the firearm once the empty magazine is released.

Preferably, the apparatus further comprises an electronic circuit, microcontroller or microprocessor adapted to be connected to the actuators for initiating the coordinating the actions of the actuators.

Preferably, the electronic circuit, microcontroller or microprocessor is adapted for automatically determining the number of bullets being fired, automatically initiating the magazine release actuator for releasing the empty magazine once all the bullets of the magazine are fired and automatically initiating the magazine loading actuator for loading the new magazine inside the firearm once the empty magazine is released and for reinitiating these actuator actions until exhaustion of all the magazines stored inside the magazine bank.

Preferably, each one of the actuators is any one of a hydraulic, electrical, pneumatic, or magnetic actuator.

Preferably, the apparatus further comprises a power supply for supplying power to the electrical/electronic components comprising the actuators and the electronic circuit/microcontroller/microprocessor.

Preferably, the apparatus is for purpose of testing at least one of the firearm and the firearm bullets.

As another aspect of the invention, there is provided a magazine bank apparatus for use with a firearm comprising:

- a magazine bank base having a plurality of slots adapted to receive and store bullet magazines;
- a magazine load actuator adapted to be automatically triggered for loading a bullet magazine among the stored bullet magazines inside the firearm.

Preferably, the magazine bank base is a rotatable magazine disk.

Preferably, the magazine bank apparatus further comprises a magazine bank actuator adapted to rotate the magazine disk at a predefined angle, direction and time to make available the bullet magazines in position to be loaded inside the firearm one at a time.

Preferably, the magazine bank apparatus 33 further comprises a microcontroller adapted to be connected to the magazine bank actuator, the microcontroller being preconfigured with the predefined angle and direction.

Preferably, the microcontroller is further adapted to be connected to the magazine load actuator for initiating the loading action of the magazine inside the firearm once the bullet magazine has been put in position to be loaded by the magazine bank actuator.

Preferably, the microcontroller is further adapted to be connected to a trigger actuator and to a magazine release actuator for releasing an empty magazine from the firearm once the bullets are fired using the trigger actuator.

Preferably, the microcontroller is further adapted to rotate the magazine disk to make available a next bullet magazine in position to be loaded once the empty magazine is released from the firearm.

Preferably, the microcontroller is further adapted to iteratively initiate the trigger actuator for firing all the bullets inside a bullet magazine, determine once all the bullets inside the magazine are fired, initiate the magazine release actuator for releasing the empty magazine once all the bullets are fired, initiate the magazine disk to rotate to make available the next bullet magazine in position to be loaded inside the firearm once the empty magazine is released, initiate the magazine loading actuator to load the next bullet magazine inside the firearm once the next magazine is in position to be loaded and to repeat these steps until all the magazines stored inside the magazine bank are exhausted.

Preferably, the slots are positioned along the radial axis of the magazine disk.

As a further aspect of the invention, there is provided method of using a firearm comprising:

a. positioning a firearm using a gripping apparatus;
b. positioning a slot having a charged magazine of a magazine bank in a first position to face a magazine receiving portion of the firearm by rotating the magazine bank along an axis of rotation in a predetermined direction by a predetermined angle using a magazine disk actuator;
c. loading the charged magazine into the firearm using a magazine loading actuator;
d. initiating a firing sequence of the firearm to fire all bullets in the charged magazine;
e. releasing the empty magazine from the firearm using a magazine release actuator;
f. moving the empty magazine into a container using a magazine discard actuator; and
g. repeating steps b through e till all charged magazines of the magazine bank are emptied.

Preferably, the positioning action of the slot comprises rotating the magazine bank to the first position within a predetermined time interval.

Preferably, the predetermined time interval is determined based on a required firing frequency for the firearm.

Preferably, the magazine bank is rotated by a step motor of a predetermined power and rounds per minute (RPM).

Preferably, the firing sequence is initiated by a trigger actuator, wherein the trigger actuator is one of a pneumatic actuator, a hydraulic actuator, an electrical actuator and a mechanical actuator.

Preferably, the trigger actuator comprises a pneumatic piston.

Preferably, initiating the firing frequency comprises determining the required firing frequency for the firearm.

BRIEF DESCRIPTION OF THE DRAWINGS

The present automatic firing apparatus and methods of use thereof will be better understood by reading the Detailed Description of the embodiments with reference to the accompanying drawing FIGS. 1-6, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION OF THE INVENTION

The automatic firing apparatus comprises a microcontroller and one or more actuators. The microcontroller may be programmed to control the automatic firing apparatus. A gripping actuator activates a gripper which holds the firearm in a required position. The gripper exerts a required force to ensure the tightness of the firearm on the fixture. A triggering actuator controls the trigger of the firearm. The firearm may fire till all the bullets in the magazine are fired. A door actuator opens a door of a container. A magazine release actuator releases an empty magazine from the firearm. A magazine bank actuator commands a motor to rotate a magazine bank in a predetermined direction by a predetermined angle. The microcontroller determines if all the charged magazines of the magazine bank have been exhausted. A magazine loading actuator loads next available charged magazine from the magazine bank in the firearm.

In describing the exemplary embodiments of the present invention, as illustrated in FIGS. 1-6 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
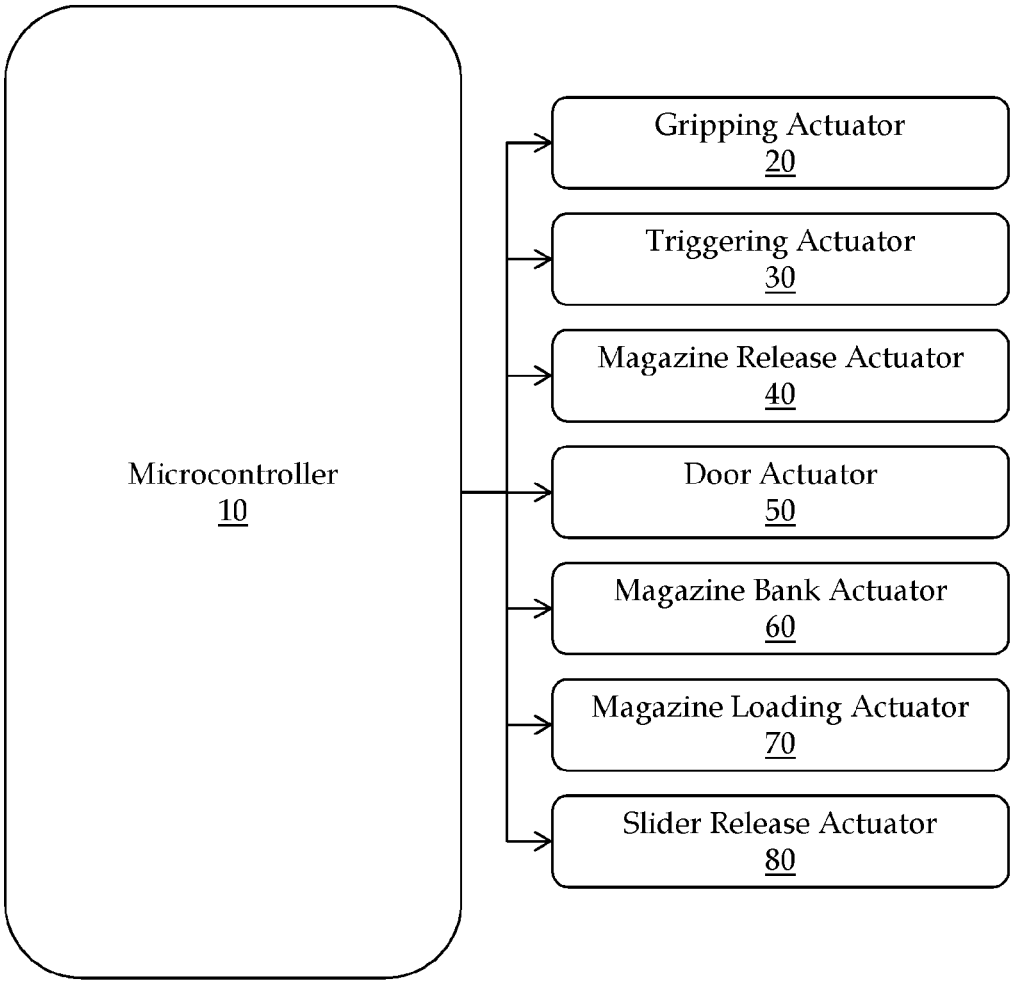
FIG. 1 illustrates block diagram of a control system for an automatic firing apparatus according to an exemplary embodiment of the present invention.

Referring now to FIG. 1, which shows a an automatic firing apparatus according to an exemplary embodiment of the present invention. The automatic firing apparatus is a power driven apparatus for automatic firing of a firearm comprising a gripping apparatus for securely gripping an arm, a gripping actuator 20 for adjusting the gripping apparatus to securely hold in place the firearm, a triggering actuator 30 for engaging a trigger of the firearm placed on the gripping apparatus, a slider release actuator 80 for engaging a release slider of the arm for releasing the bullets, a magazine release actuator 40 for releasing the empty magazine from the firearm when all the bullets of the magazine have been fired, a door actuator 50 for pushing the released magazine inside a container to store the empty magazines, a rotating magazine bank for storing filled magazines, a magazine bank actuator 60 for rotating the magazine bank according to predetermined angle, direction and time, a magazine loading actuator 70 for loading a filled magazine from the magazine bank inside the firearm, and a microcontroller 10 in connection with the gripping actuator 20, the triggering actuator 30, the slider release actuator 80, the magazine release actuator 40, the door actuator 50, the magazine bank actuator 60 and the magazine loading actuator 70 for coordinating the actions of the actuators.

Figure 2:
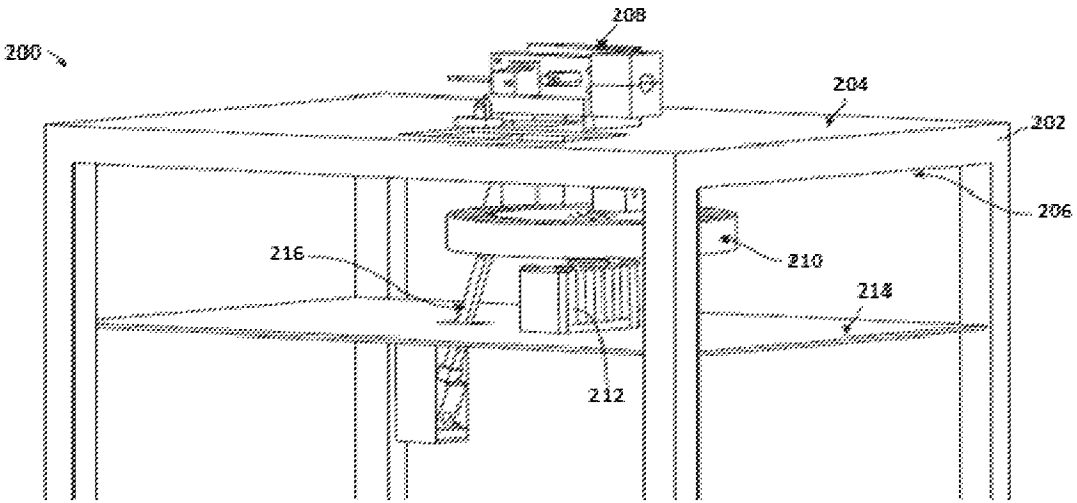
FIG. 2 illustrates an exemplary view of an automatic firing apparatus according to one embodiment of the present invention.

Referring now to FIG. 2 which illustrates an exemplary view of an automatic firing apparatus 200 according to one exemplary embodiment of the present invention. The automatic firing apparatus 200 has a base 202 to which one or more components may be coupled to or operatively connected to. In one embodiment, the base 202 is rectangular. However, a person of ordinary skill in the art would understand that the base 202 may be triangular, circular, poles or of any other appropriate shape. In one embodiment, the base 202 is made of stainless steel. However, a person of ordinary skill in the art would understand that the base 202 may be made of any other metal, alloy, plastic, wood, or any other appropriate material. In one embodiment, the base 202 is an upper portion of a table. The base 202 provides stability and support to other components attached thereto.

An arm module 208 is coupled to a first surface 204 of the base 202. The arm portion may receive a firearm therein and grip it firmly in place. The arm module 208 may be operatively connected to the gripping actuator 20, the triggering actuator 30, the magazine release actuator 40, the door actuator 50, the magazine bank actuator 60, the magazine loading actuator 70, and the slider release actuator 80 for operating the automatic firing apparatus 200.

Further, a magazine bank 210 is operatively connected to a second surface 206 of the base 202. In one embodiment, the second surface 206 of the base 202 is substantially parallel to the first surface 204 of the base 202. The magazine bank 210 may be positioned on a support 214 and operatively connected to the base 202. The magazine bank 210 may be rotated about an axis of rotation in a predetermined direction by a predetermined angular distance. An angular speed and an angular acceleration of the rotation of the magazine bank 210 may also be controlled using the microcontroller 10 via the magazine bank actuator 60.

In one embodiment of the present invention, the magazine bank actuator 60 may activate a motor that may rotate the magazine bank 210 based on one or more commands received from the microcontroller 10. In one embodiment, the motor is a servo motor. The servo motor controls an angular position of the rotating magazine bank 210. In one embodiment, the servo motor is a velocity controlled servo motor. In this embodiment, recalibration of the servo motor is performed by adding a potentiometer. The potentiometer readings are transferred into angles traveled by the servo motor. The potentiometer readings may be converted into required angular distance and the servo motor may rotate the magazine bank 210 to the required position.

In another embodiment, the magazine bank 210 may be rotated by any other rotational mechanism known in the art without departing from the scope of the present invention. The rotational mechanism used should be able to rotate the magazine bank 210 with a predetermined angular velocity and a predetermined angular acceleration. More details of the magazine bank 210 are illustrated with reference to FIG. 4.

The automatic firing apparatus 200 may further include one or more power supplies 212. The power supplies 212 may be positioned at the support 214. The power supplies 212 provide power to one or more power operated components of the automatic firing apparatus 200. In one embodiment of the present invention, the power supplies 212 supplies power to the gripping actuator 20, the triggering actuator 30, the magazine release actuator 40, the door actuator 50, the magazine bank actuator 60, the magazine loading actuator 70, and the slider release actuator 80 of the automatic firing apparatus 200.

The automatic firing apparatus 200 may further include a control box (not shown) having therein the microcontroller 10 and one or more controllers for the gripping actuator 20, the triggering actuator 30, the magazine release actuator 40, the door actuator 50, the magazine bank actuator 60, the magazine loading actuator 70, and the slider release actuator 80. In one embodiment of the present invention, one or more of the actuators 20, 30, 40, 50, 60, 70 and 80 may include linear actuators. In one embodiment of the present invention, the one or more of the actuators 20, 30, 40, 50, 60, 70 and 80 may be operated by a hydraulic, mechanical, electrical, pneumatic, or magnetic means. The microcontroller 10 may control one or more functions and timing of the one or more controllers associated with the actuators 20, 30, 40, 50, 60, 70 and 80.

The automatic firing apparatus 200 may further include a trigger means 216. In one embodiment, the trigger means 216 is a pneumatic piston. The pneumatic piston may be controlled based on one or more commands from the microcontroller 10. The pneumatic piston pulls and releases a trigger of a firearm at a predetermined frequency.

Figure 3:
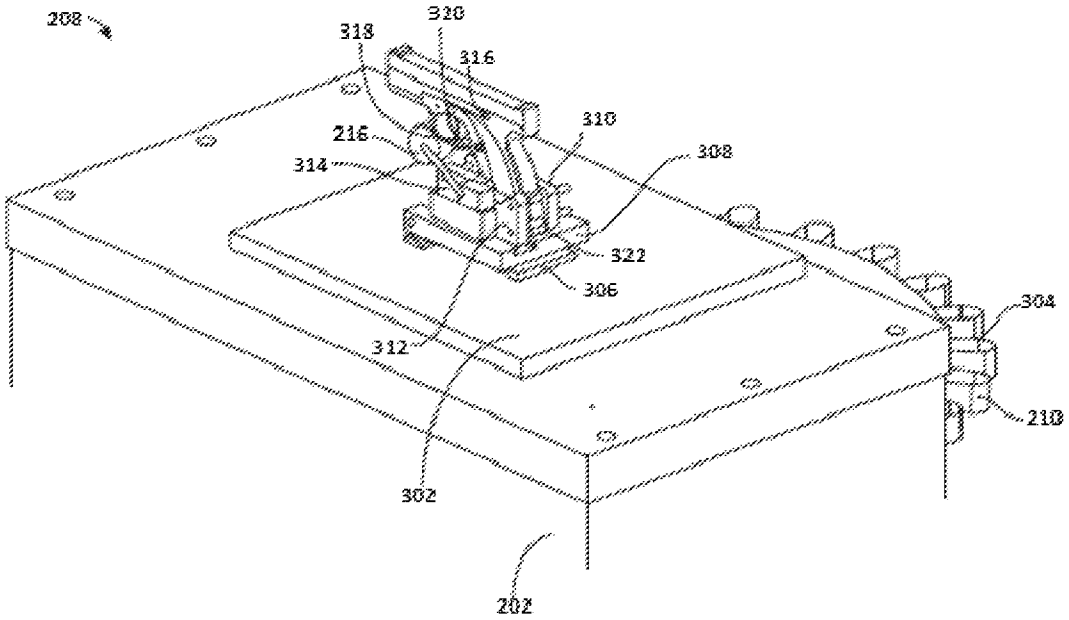
FIG. 3 illustrates an exemplary view of an automatic firing apparatus of FIG. 2 with a firearm positioned thereat according to one embodiment of the present invention.

Referring now to FIG. 3, which illustrates an exemplary view of the automatic firing apparatus 200 with a firearm 322 positioned thereat according to one embodiment of the present invention.

A base plate 302 is affixed to the base 202. A holder 306 is affixed at the top of the base plate 302. A fixture is supported on the holder 306. The fixture includes a fixture base 308, fixture plates 310 and 314, and a fixture slider 312. The fixture base 308 may be attached to the holder 306 with nuts and bolts, screws or any other preferred mechanism. The fixture plates 310 and 314 are arranged perpendicular to the fixture base 308 and substantially parallel to each other at a predetermined distance from each other so that a hollow receiving portion is formed between them. The distance between the fixture plates 310 and 314 may be varied for accommodating firearms of different sizes or shapes.

A firearm 322 is shown in a simplified manner for the sake of clarity. The firearm 322 is shown raised from its actual position for the sake of clarity and explanation. The firearm 322 has slide button 316 which is operated with the fixture slider 312. The movement of the fixture slider 312 can operate to release and hold the slide button 316 of the firearm 322.

The firearm 322 further includes a trigger 318 which is operatively connected to the pneumatic piston 216 via the triggering actuator 30. The movement of the pneumatic piston along its axis pulls and releases the trigger 318 to achieve firing of bullets from the firearm 322 at a predetermined rate.

The firearm 322 further includes a magazine release button 320 which is operatively connected to the magazine release actuator 40 to release an empty magazine from the firearm 322.

Also shown in FIG. 3 is a partial view of the magazine bank 210. The magazine bank 210 has a plurality of slots 304 to hold one or more magazines. The complete operation of the automatic firing apparatus 200 is further explained with reference to FIGS. 5-6.

Figure 4:
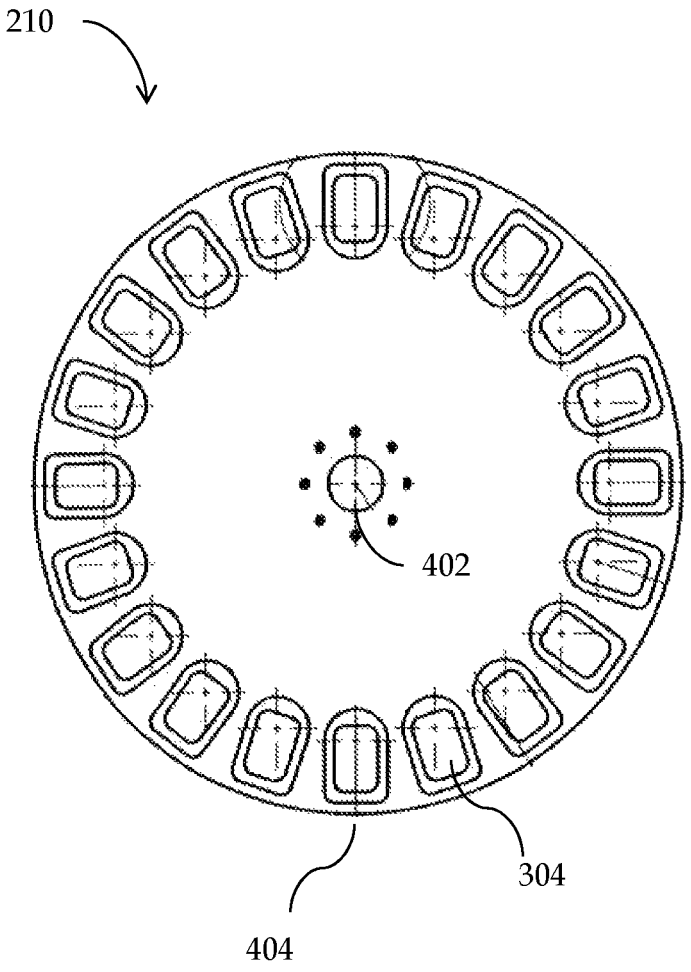
FIG. 4 illustrates a magazine bank of the automatic firing apparatus according to one embodiment of the present invention.

Referring now to FIG. 4, which illustrates in an exemplary embodiment, a top view of the magazine bank 210 of the automatic firing apparatus 200. The magazine bank 210 has a base having a first surface, a second surface substantially parallel to the first surface. The magazine bank 210 may have an intermediate structure for coupling the first surface and the second surface at a predetermined distance from each other. The magazine bank 210 includes a plurality of slots 304 movable in a direction substantially perpendicular the first surface. The magazine bank 210 has an attached pushing mechanism which is configured to push a slot of the plurality of slots 304 in the movable direction. As described above with reference to FIG. 2, the magazine bank 210 may be rotated about an axis of rotation 402 with a predetermined angular velocity. In one embodiment the axis 402 is substantially perpendicular to the base of the magazine bank 210. In one embodiment, a servo motor rotates the magazine bank 210 on receiving a command from the microcontroller 10 via the magazine bank actuator 60.

In one embodiment of the present invention, shape of the magazine bank 210 is one of a cuboid, a cube, a hollow disk and a solid disk. In one embodiment, the magazine bank 210 has the plurality of slots 304 arranged around the axis 402 among one or more plates. The one or more plates are positioned at different radial distances from the axis 402. Although only a single plate comprising the plurality of slots 304 arranged along a periphery 404 of the circular disk is shown in FIG. 4, it is contemplated that more than one plates of the plurality of slots 304 may be arranged on the magazine bank 210 with suitable modification. Therefore, arrangement of the plurality of slots 304 in various configurations is considered to be within the scope of the present invention. The number of the plurality of slots 304 may be varied as per the requirement.

Figure 5:
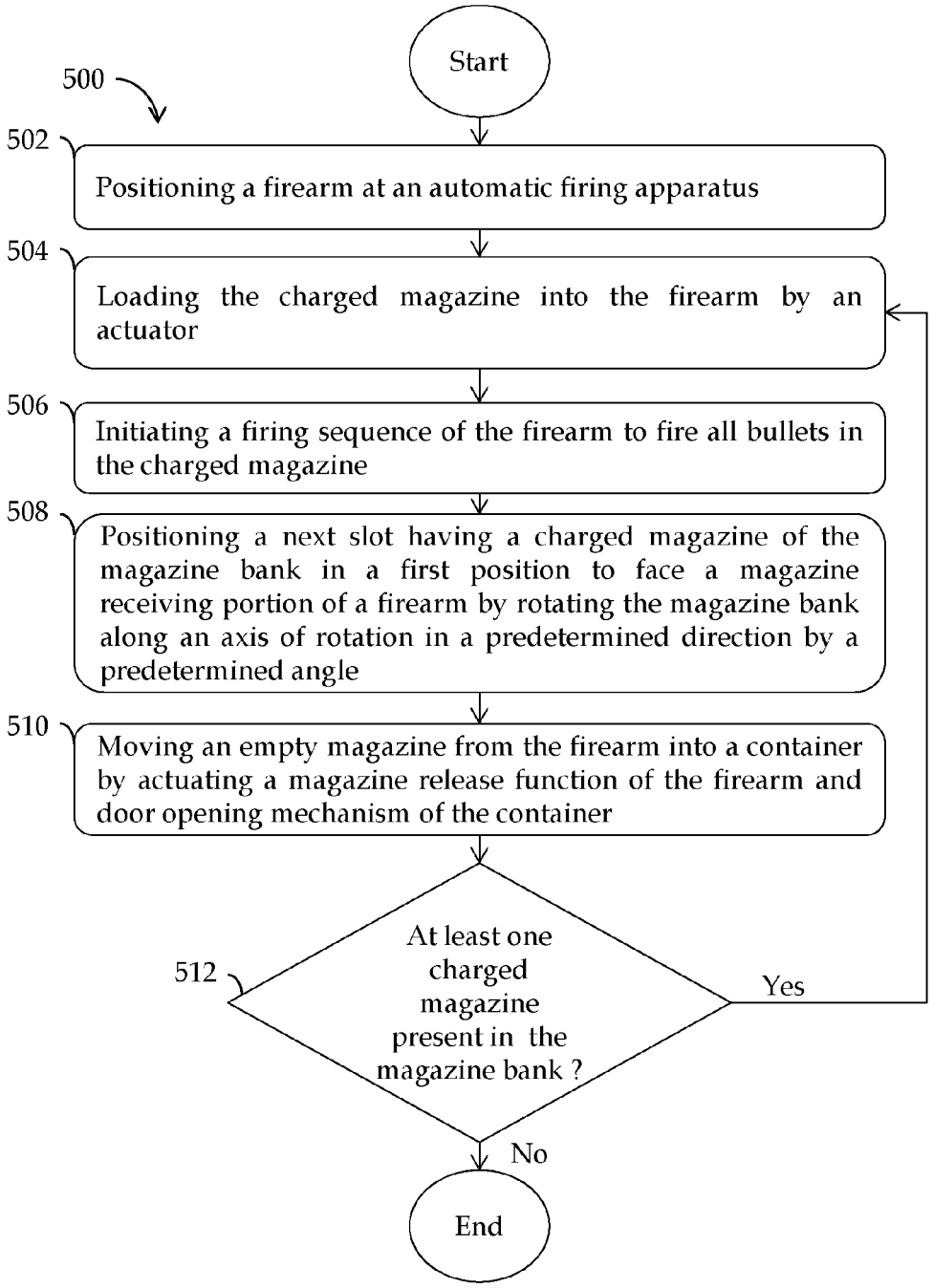
FIG. 5 shows a flow diagram illustrating a method for automatic firing apparatus according to an embodiment of the present invention.

Referring now to FIG. 5, which shows a flow diagram illustrating a method 500 for automatic firing apparatus 200 according to an exemplary embodiment of the present invention. The method starts at step 502.

At step 502, the firearm 322 is positioned in a receiving portion of the arm module 208 of the automatic firing apparatus 200. A gripping mechanism is activated by providing a command from the microcontroller 10 via the gripping actuator 20. The gripping actuator 20 activates a gripper which holds the firearm 322 in a required position. In one embodiment of the present invention, the fixture plates 310 and 314 are moved to grip the firearm 322. In another embodiment, additional grippers may be used to restrict the movement of the firearm 322 in a particular direction. The step 502 may further include putting one or more charged magazines in the magazine bank 210. In one embodiment, the magazine bank 210 has N slots each is filled with a charged magazine, where N is a natural number. In one embodiment, one or more slots of the magazine bank 210 remain empty.

Once the firearm 322 is firmly gripped at the arm module 208 and the magazine bank 210 has been filled with one or more charged magazines, the method proceeds to step 504.

At step 504, a charged magazine from the magazine bank 210 is loaded into the firearm 322. The loading may be performed by various loading means. In one embodiment, the magazine loading actuator 70 pushes the charged magazine from the slot of the magazine bank 210 upwards into the magazine receiving portion of the firearm 322. In one embodiment, the magazine loading actuator 70 is a linear actuator. Simultaneously, the magazine release actuator 40 may operate on the magazine release button 320 of the firearm 322 to facilitate the loading of the charged magazine into the firearm 322. Alternative mechanisms such as pneumatic, hydraulic, mechanical, electrical, or magnetic to load the charged magazine from the magazine bank 210 into the firearm 322 are considered within the scope of the present invention. The magazine release actuator 40 and the magazine loading actuator 70 may be controlled by the microcontroller 10.

At step 506, a firing sequence of the firearm 322 is initiated by activating the pneumatic piston 216 which controls the trigger 318 of the firearm 322. The firing sequence is continued till all bullets in the charged magazine are fired. Subsequently, the empty magazine is released from the firearm 322 and moved to a container (not shown) which is operatively connected to the arm module 208 and collects the empty magazines. Moving an empty magazine from the firearm 322 to the container may be achieved with the help of magazine release actuator 40 and the door actuator 50. The door actuator 50 opens a door of the container and the magazine release actuator 40 pushes the magazine release button 320 so the empty magazine drops into the container. Once the empty magazine has been moved from the firearm 322 into the container, the door of the container is closed by the door actuator 50. At that moment in the method 500, the magazine receiving portion of the firearm 322 faces an empty slot of magazine bank 210. To load the next available charged magazine from the magazine bank 210 into the firearm 322, the magazine bank 210 needs to be rotated which function is achieved in step 508 as explained below.

At step 508 a slot of the magazine bank 210 having a charged magazine is positioned in a first position to face a magazine receiving portion of the firearm 222 by rotating the magazine bank 210 along the axis of rotation 402 in a predetermined direction by a predetermined angle. In one embodiment, the magazine bank 210 is rotated by the magazine bank actuator 60 on receiving a command from the microcontroller 10. In one embodiment of the present invention, the angle of rotation may be determined by number or slots available on the magazine bank 210. For example, if the magazine bank 210 has N slots then the required angle of rotation may be obtained by dividing 360 by N. Once the angle of rotation is determined, the servo motor may receive a command from the microcontroller 10 to rotate the magazine bank 210 by the determined angle of rotation. The direction of the rotation of the magazine bank 210 may be either clockwise or anticlockwise. The rotation of the magazine bank 210 places the next available charged magazine in a position from which the charged magazine can be loaded into the firearm 322 as explained in step 504.

At step 510, the empty magazine is released from the firearm 322 and moved into the container as explained in step 506.

At step 512, it is determined whether there is at least one charged magazine in the magazine bank 210. If it is determined at step 512 that there is at least one charged magazine present in the magazine bank 210 then the method 500 proceeds to step 504. However, if it is determined at step 512 that there is no charged magazine present in the magazine bank 210 then the method is ended.

Figure 6:
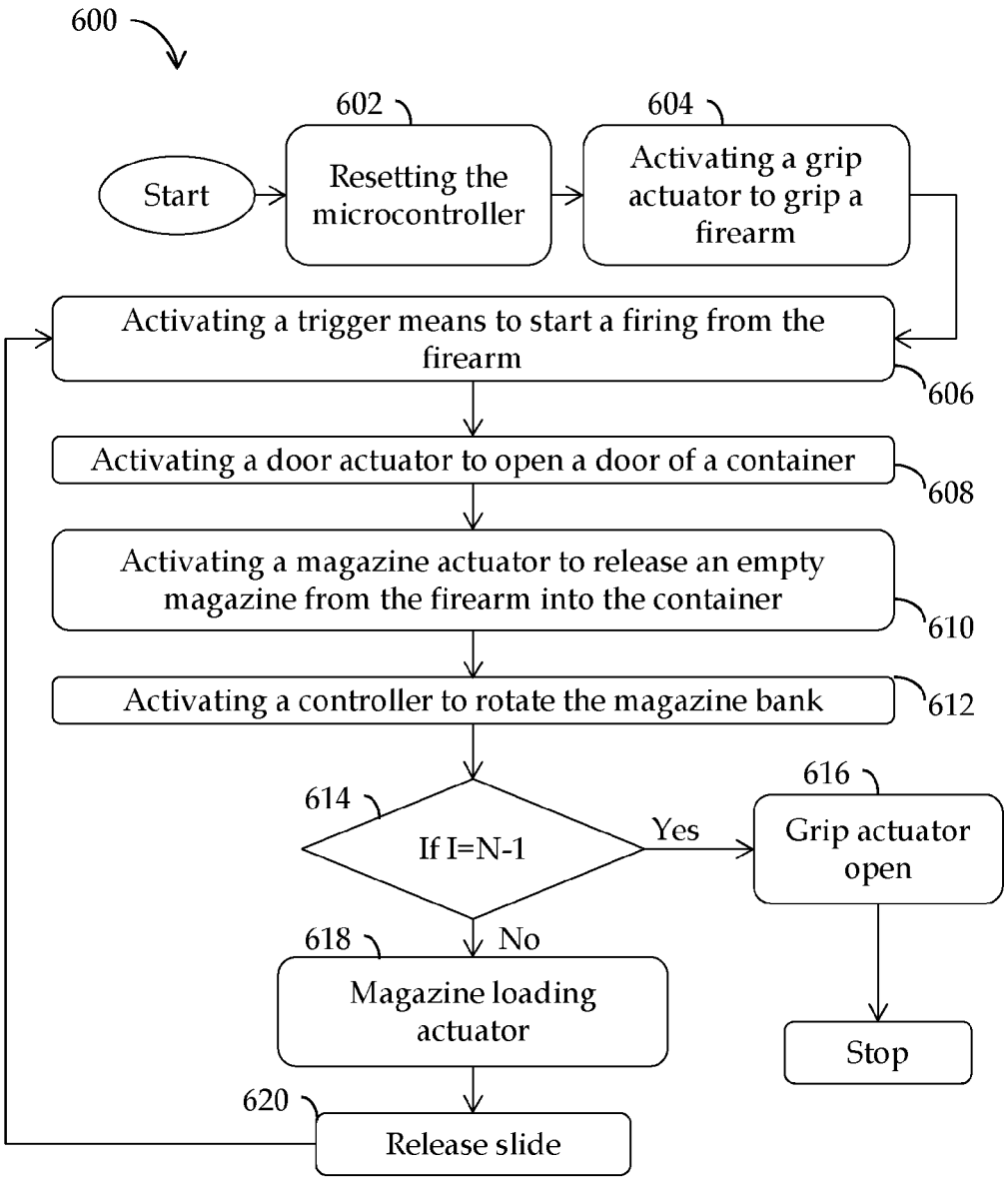
FIG. 6 shows a logical flow diagram illustrating a control sequence of the automatic firing apparatus.

Referring now to FIG. 6, which shows a logical flow diagram illustrating a control sequence 600 of the microcontroller 10 of the automatic firing apparatus 200. The sequence 600 starts with step 602. At step 602 the microcontroller 10 is reset. The microcontroller 10 may be programmed to loop the control sequence N times, where N is the number of slots available on the magazine bank 210. At step 604, control transfer to the gripping actuator 20. The gripping actuator 20 activates a gripper which holds the firearm 322 in a required position. The gripper exerts required force to ensure the tightness of the firearm 322 on the fixture. In one embodiment of the present invention, a feedback sensor is installed within the gripping actuator 20 to ensure that a stroking length is positioned accurately as much as possible and the force exerted is consistently the required force to hold the firearm 322 firmly in position.

At step 606, the control passes to the trigger means 216 via the triggering actuator 30 which controls the trigger 318 of the firearm 322. The trigger means 216 may fire till all the bullets in the magazine are fired.

At step 608, the control passes to the door actuator 50 which opens the door of the container. At step 610, the control passes to the magazine release actuator 40 which releases an empty magazine from the firearm 322. The control is passed again to the door actuator 50 to close the door of the container.

At step 612, the control passes to the magazine bank actuator 60 and commands the servo motor to rotate the magazine bank 210 in a predetermined direction by a predetermined angle along the axis of rotation 402 of the magazine bank 210. Then the control passes to the microcontroller 10 at step 614 which determines if all the charged magazines of the magazine bank 210 have been exhausted. In one embodiment, this is determined by comparing a loop variable 'I' to the number of slots 'N' in the magazine bank 210. If 'I' equals 'N−1' at step 614 then all the charged magazines of the magazine bank 210 have been exhausted. Thereafter, the control passes to the gripping actuator 20 at step 516 which opens the gripper and the control sequence ends. However, If '$I<N-1$', at step 614, the control passes to the magazine loading actuator 70 which at step 618 loads next available charged magazine from the magazine bank 210 in to the firearm 322. At step 620, the control passes to the slider release actuator 80 and the triggering actuator 30. As already noted above, the control sequence is repeated till all the charged magazines in the magazine bank 210 have been exhausted.

The foregoing specification describes the automatic firing apparatus 200 comprises the microcontroller 10 programmed to control the automatic firing apparatus 200. The automatic firing apparatus 200 is safe, reliable, easy to use and maintain, stable, and portable. Further, the automatic firing apparatus 200 is configurable to fire and test different types of firearms which may have differing shapes and sizes.

The foregoing description and drawings comprise illustrative embodiments of the present invention. Having thus described exemplary embodiments, it should be noted by those ordinarily skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method.

Many modifications and other embodiments of the invention will come to mind to one ordinarily skilled in the art to which this invention pertains having the benefit of the teachings presented in the foregoing descriptions and the associated drawings. Although specific terms may be employed herein, they are used in a generic and descriptive sense only and not for purposes of limitation.

Moreover, the present invention has been described in detail; it should be understood that various changes, substitutions and alterations can be made thereto without departing from the spirit and scope of the invention as defined by the appended claims. Accordingly, the present invention is not limited to the specific embodiments illustrated herein, but is limited only by the following claims.

The invention claimed is:

1. An automated method of using a firearm comprising using an electronic circuit, a microcontroller or a microprocessor for:

a. positioning a firearm using a gripping apparatus;

b. positioning a slot having a charged magazine of a magazine bank in a first position to face a magazine receiving portion of the firearm by rotating the magazine bank along an axis of rotation in a predetermined direction by a predetermined angle using a magazine disk actuator;

c. loading the charged magazine into the firearm using a magazine load actuator;

d. initiating a firing sequence of the firearm to fire all bullets in the charged magazine;

e. releasing the empty magazine from the firearm using a magazine release actuator;

f. moving the empty magazine into a container using a magazine discard actuator; and g. repeating steps b through e till all charged magazines of the magazine bank are emptied, wherein the method further comprises automatically determining the number of bullets fired and based on said determination automatically releasing the empty magazine from the firearm once all the bullets of the magazine are fired;

wherein the positioning action of the slot comprises rotating the magazine bank to the first position within a predetermined time interval; and wherein the predetermined time interval is determined based on a required firing frequency for the firearm.

2. The method of claim 1, wherein the magazine discard actuator is any one of a hydraulic, electrical, pneumatic, or magnetic actuator.

3. The method of claim 1, wherein the magazine bank is rotated by a step motor of a predetermined power and rounds per minute (RPM).

4. The method of claim 3, wherein the firing sequence is initiated by a trigger actuator, wherein the trigger actuator is one of a pneumatic actuator, a hydraulic actuator, an electrical actuator and a mechanical actuator.

5. The method of claim 4, wherein the trigger actuator comprises a pneumatic piston.

6. The method of claim 4, wherein initiating the firing sequence comprises determining the required firing frequency for the firearm.

7. The method of claim 1, wherein the positioning of the gripping apparatus is conducted using a gripping actuator for securely gripping the firearm in place before initiating the triggering actuator.

8. The method of claim 1, wherein the container comprises a door, and the method further comprises opening the container door using a door actuator once the empty magazine is released, wherein the empty magazine is forced inside the container through the opened door using the magazine discard actuator after the door is opened.

9. The method of claim 1, wherein the magazine loads actuator is adapted to be automatically triggered for loading a bullet magazine among the stored bullet magazines inside the firearm.

10. The method of claim 1, wherein the method further comprises a magazine release button operatively connected to the magazine release actuator to release an empty magazine from the firearm.

* * * * *